US006192716B1

(12) United States Patent
Essig et al.

(10) Patent No.: US 6,192,716 B1
(45) Date of Patent: Feb. 27, 2001

(54) METHOD OF CONNECTING TWO KNITTED PARTS ON A FLAT KNITTING MACHINE

(75) Inventors: Horst Essig, Hülben; Oliver Vogt, Reutlingen, both of (DE)

(73) Assignee: H. Stoll GmbH & Co., Reutlingen (DE)

( * ) Notice: Subject to any disclaimer, the term of this patent is extended or adjusted under 35 U.S.C. 154(b) by 0 days.

(21) Appl. No.: 09/148,594

(22) Filed: Sep. 4, 1998

(30) Foreign Application Priority Data

Sep. 6, 1997 (DE) ..... 197 39 136

(51) Int. Cl.[7] ..... D04B 7/00
(52) U.S. Cl. ..... 66/60 R; 66/64
(58) Field of Search ..... 66/64, 60 R, 62, 66/69, 75.1, 170, 171, 173, 172 R, 174, 175, 201

(56) References Cited

U.S. PATENT DOCUMENTS 5,203,185 4/1993 Okuno ..... 66/171
5,257,514 * 11/1993 Okuno ..... 66/64
5,284,031 * 2/1994 Stoll et al. ..... 66/64
5,377,507 * 1/1995 Shima ..... 66/69
5,388,430 2/1995 Essig ..... 66/64
5,584,197 * 12/1996 Okuno ..... 66/64
5,669,244 * 9/1997 Okuno ..... 66/64
5,826,445 10/1998 Okamoto ..... 66/70

* cited by examiner

*Primary Examiner*—John J. Calvert
*Assistant Examiner*—Robert H. Muromoto
(74) *Attorney, Agent, or Firm*—Michael J. Striker

(57) ABSTRACT

A method of connecting two knitted parts on a flat knitting machine with at least two opposite needle beds, a needle bed displacing device and a stitch suspending-over device, has the steps of suspending over of both knitted parts in neighboring needles of one needle bed, subsequently suspending of stitches of one knitted part by so many needle distances in direction toward the other knitted part that both corresponding bordering stitches are located on one needle and knitted together, before a new suspension over of stitches of one of the knitted parts is performed by so many needle distances that the bordering stitches overlap one another and knitting off of the bordering stitches is performed, and repeating of these steps until all stitches of both knitted part are connected with one another.

8 Claims, 4 Drawing Sheets

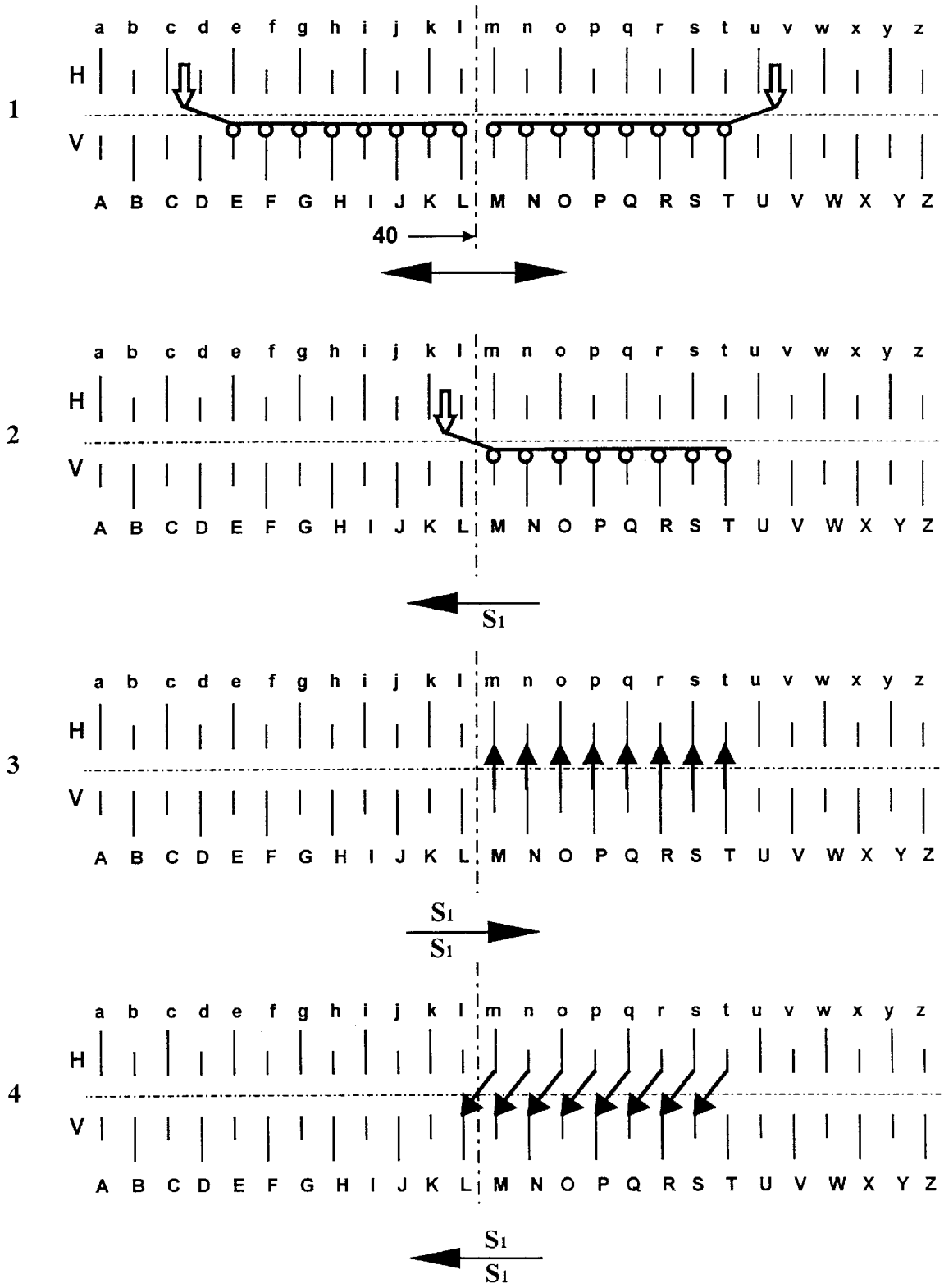
Fig. 6.1

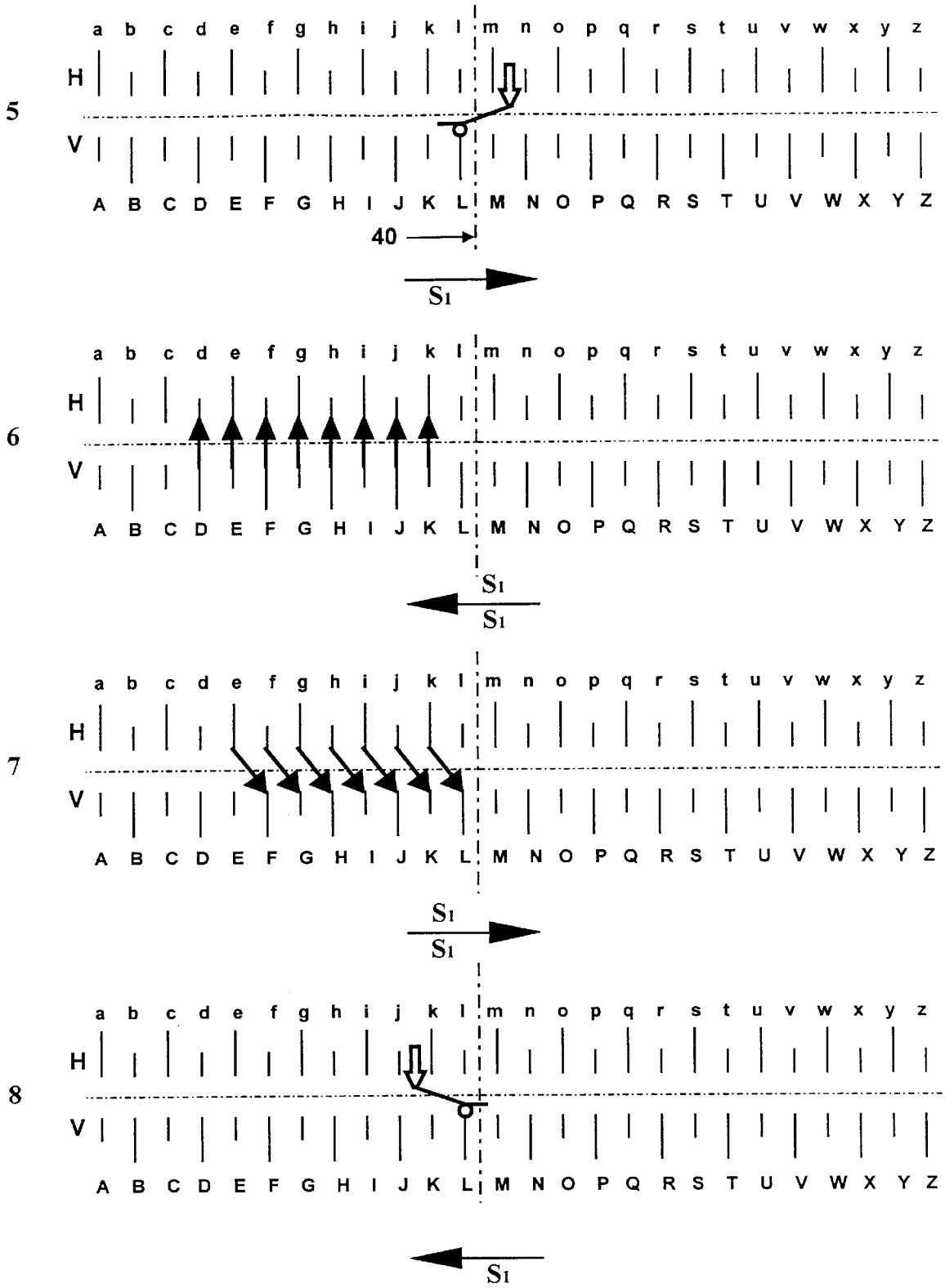
Fig. 6.2

METHOD OF CONNECTING TWO KNITTED PARTS ON A FLAT KNITTING MACHINE

BACKGROUND OF THE INVENTION

The present invention relates to a method of connecting two knitted parts on a flat knitting machine.

During the manufacture of knitted articles which are assembled of several individual knitted parts, it is necessary as a rule to provide tooth-working steps which generally are not automated and therefore are cost intensive. For a rationale manufacture of knitted articles, it is therefore necessary to develop a method of machine connection of knitted parts during a knitted process. The produced connecting points must satisfy all requirements with respect to optical impression and support comfort.

SUMMARY OF THE INVENTION

Accordingly, it is an object of the present invention to provide a method of connecting two knitted parts on a flat knitting machine, which is a further improvement of the known methods.

In keeping with these objects and with others which will become apparent hereinafter, one feature of present invention resides, briefly stated in a method of connecting two knitted parts on a flat knitting machine with at least two opposite needle beds, a needle racking device and a machine take up device, in which the both knitted parts are suspended over in neighboring needles of one needle bed and subsequently the stitches of one knitted part are further suspended over by so many needle distances in direction to the other knitted part that both corresponding bordering stitches come together on one needle and are knitted off jointly, before a new suspended over of the stitches of one of the knitted parts is performed by so many needle distances that the bordering stitches are overlapped and knitting off of the bordering stitches is performed, and this process is repeated until all stitches of both knitted parts are connected with one another.

The knitted parts can be suspended over preferably in alternating order in direction toward the other knitted article. This method can be used for knitted parts in all binding and pattern types. Since the connecting seam must be flat and does not project from the connected knitted parts, the connecting knitting row is single-layered.

During connection of multi-layered knitted parts, they can be provided before the suspension near one another on a needle bed with a single-layered end row. For knitted parts which are produced by sectors alternatingly on one or both needle beds, the stitches can be so suspended over, that all stitches are located on one needle bed. With the use of the inventive method it is possible to produce connecting seams which extend vertically, horizontally, or at any desired angle.

The drawings illustrate the formation of a connecting seam between knitted parts over a needle which correspond to the finest possible connection. With the same method it is also possible to produce connecting seams via several knitting needles, as desired in view of the pattern or for producing a special connecting affect.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 6 is a view showing a stitch course of the connection of two knitted parts.

DESCRIPTION OF PREFERRED EMBODIMENTS

Figure 1:
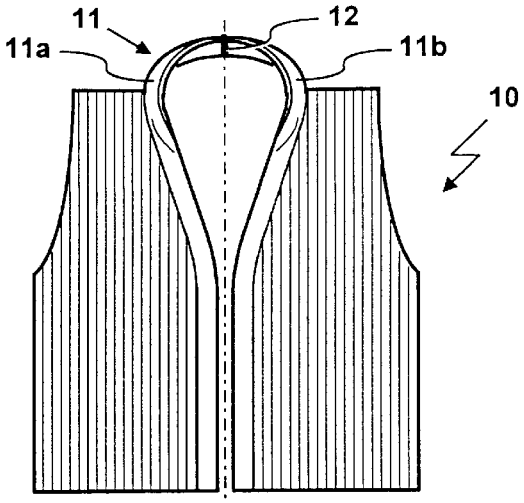
FIG. 1 is a view showing a first knitted article composed of two partial knitted articles, with a vertical extension of a connection seam.

FIG. 1 shows a pullover 10 with a collar 11 composed of two knitted parts 11*a* and 11*b*. Both knitted par s 11*a*, 11*b* are connected with one another at a connecting point 12 in the region of the neck. A knitted article 20 shown in FIG. 2 is a vest whose front part 21 and 22 are connected with a rear part 23 in the region of shoulders 24 in accordance with a method of the present invention.

Figure 2:
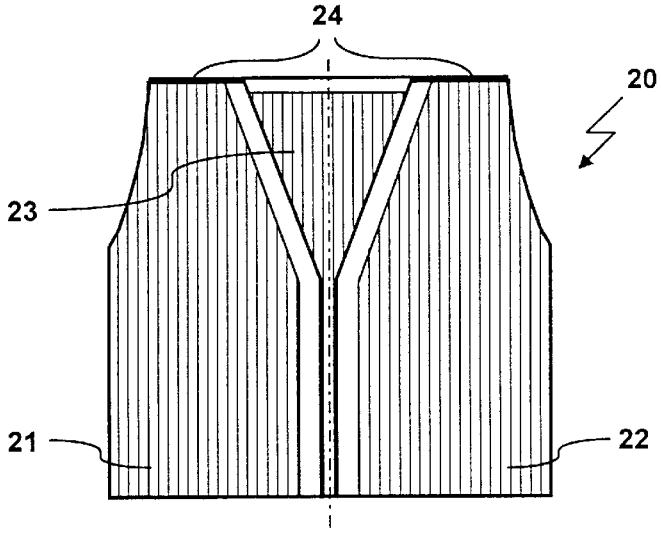
FIG. 2 is a view showing a second knitted article formed of three partial knitted articles and having a horizontal extension of the connection seam.

The knitted articles 10 and 20 of FIGS. 1 and 2 are knitted articles whose knitted parts 11*a*, 11*b* and 21, 22, 23 are formed in the same knitting plane. In contrast, a knitted article 30 with a collar 31 shown in FIG. 3 is composed of two parts 31*a*, 31*b* which are produced on opposite needle beds and subsequently connected with one another in a connecting point 32 in the neck.

Figure 4:
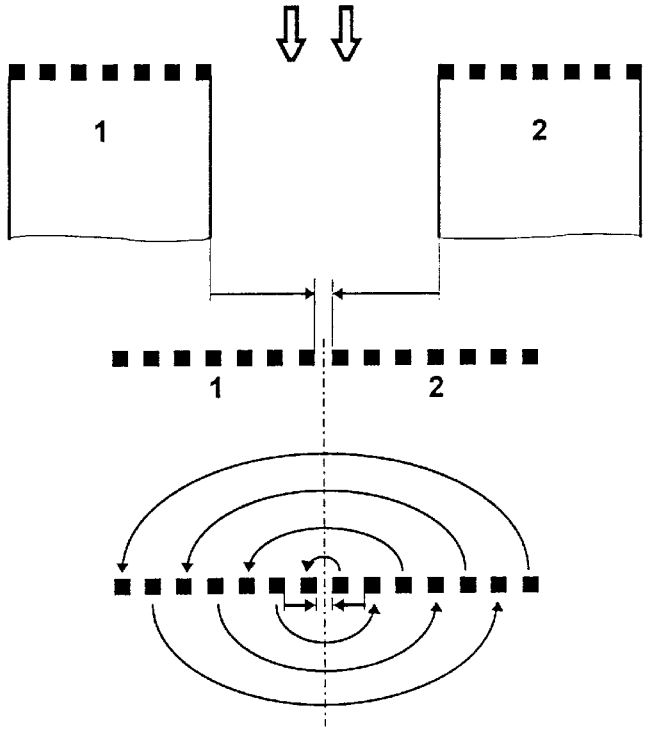
FIG. 4 is a schematic view of a connection of the knitted parts of the knitted article of FIGS. 1 and 2.

The connection of the knitted parts 11*a*, 11*b*, 21, 22 and 23 of the knitted articles 10 and 12 is schematically illustrated in FIGS. 1, 2 and in FIG. 4. First the both knitted parts which are identified with reference numerals 1 and 2 and are suspended on the same needle bed, are suspended in neighboring needles of these needle beds. Subsequently, by alternating suspending over of the stitches of the knitted parts 1 and 2 in direction to the corresponding another knitted part 2, 1 the production of overlapping bordering stitches which are stitched off near one another is performed. Thereby a stitch-accurate connection of both knitted parts 1 and 2 is produced, which moreover does not protrude, or in other words does not limit the varying comfort of a closing article.

Figure 3:
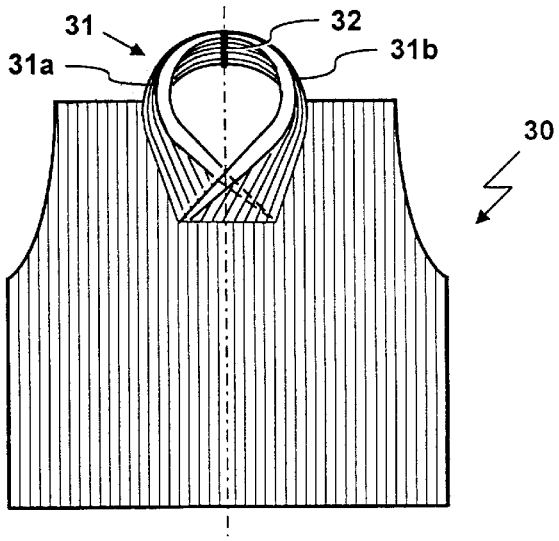
FIG. 3 is a view showing a third knitted articles composed of two partial knitted articles and having a vertical extension of the connection seam.
Figure 5:
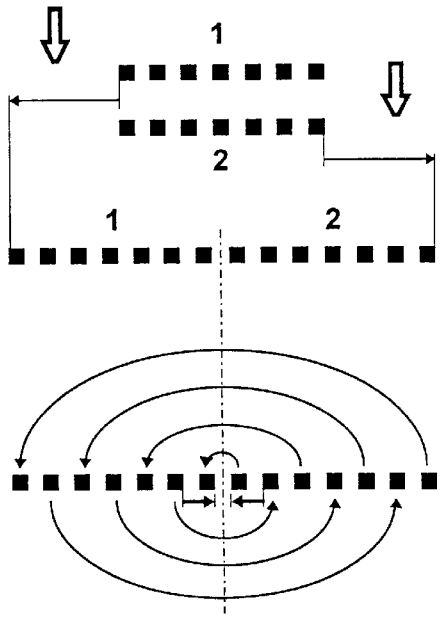
FIG. 5 is a schematic view of the connection of both knitted parts of the knitted article of FIG. 3.

FIG. 5 shows the method of connecting the both collar parts 31*a* and 31*b* of the knitted article 30 of FIG. 3 in a sketch manner. The both knitted parts which are identified here with reference numerals 1 and 2 are located on opposite needle beds. Before the connection, they are suspended over on one needle bed and so that they are suspended in neighboring needles of this needle bed. Subsequently the connection itself is performed by suspending over the stitches of one knitted parts to the direction of the other knitted part and knitting over the overlapping bordering stitches, as shown in FIG. 4.

FIG. 6 shows a stitch coarse of the connection of both knitted parts 1 and 2 of FIGS. 4 and 5 in accordance with which they are suspended over on neighboring needles of one needle bed. Here the front needle bed V. The connection can be however performed also on the needles of the rear needle bed. The bordering line between the both knitted parts 1 and 2 is identified with reference numeral 40. After the connection the preceding suspending over processes of both knitted parts 1 and 2 produce the image shown in FIG. 1. Subsequently in row 2 stitches are formed over the right knitted part, so that the associated thread guides are placed at the left of the needle A of the left knitted part. The connection is then formed with the needle L. In row 3 in the knitting direction from left to right with a first knitting system S1, stitches of the right knitted part are suspended over on the rear needle bed H. In row 4 in the knitting direction from right to left after displacing movement of the rear needle bed H to the left, the suspension back of the stitches of the right knitted part from the rear needle bed H to the front needle bed V is performed. All stitches of the right knitted part are therefore displaced by one needle in direction to the left knitted part. Thereby the bordering stitches of the left knitted part and the bordering stitches of the right knitted part are located on the needle L.

In row 5 in the knitting direction from left to right with the first knitting system S1 and the thread guide, the bubble stitches located on the needle L are knitted off and thereby both knitted parts are connected. Subsequently, the thread guide is located at the right side of the needle L. In row 6 all stitches of the left knitted part are suspended over from the front needle bed V to the rear needle bed H. In row 7 after a displacement movement of the rear needle bed H to the right, with the first knitting system S1 the suspension back of the stitches of the left knitted part from the rear needle bed H to the front needle bed V is performed. All stitches of the left knitted part are displaced now by one needle. Thereby on the needle L, the connecting stitches from row 5 and the limiting stitches of the left knitted article are located. This double stitch is knitted off in row 8 in the knitting direction from right to left with the first knitting system S1 and the thread guide, and thereby bound off. The thread guide is located now again left near the needle L. Subsequently the cycle of the rows 3–8 is repeated until all stitches of the knitted parts are connected with one another in the region of the connecting point.

The connecting seam of the knitted parts 1 and 2 can be produced so that it extends horizontally, vertically or at any other angle.

It will be understood that each of the elements described above, or two or more together, may also find a useful application in other types of methods and constructions differing from the types described above.

While the invention has been illustrated and described as embodied in method of connecting two knitted parts on a flat knitting machine, it is not intended to be limited to the details shown, since various modifications and structural changes maybe made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of connecting two knitted parts on a flat knitting machine with at least two opposite needle beds, a needle bed displacing device and a stitch suspending-over device, comprising the steps of suspending over both knitted parts in neighboring needles of one needle bed; substantially suspending of stitches of one knitted part by so many needle distances in direction toward the other knitted part that both corresponding bordering stitch of a first knitted part and a corresponding bordering stitch of a second knitted part are located on one needle and knitted together, before a new suspension over of stitches of one of the knitted parts is performed by so many needle distances that the bordering stitches overlap one another and knitting off of the bordering stitches is performed; and repeating of these steps until all bordering stitches of both knitted part are connected with one another.

2. A method as defined in claim 1; and further comprising the step of suspending of one of the knitted parts in an alternating order in direction toward the other of the knitted parts.

3. A method as defined in claim 1; and further comprising forming of the knitted parts as multi-layered knitted parts and providing of the multi-layered knitted parts before their suspension near one another on one needle bed, with a single-layered end knitting row.

4. A method as defined in claim 1; and further comprising forming of a connecting seam as a one-layered connection.

5. A method as defined in claim 1; and further comprising suspending of the knitted parts which are formed on opposite needle beds, on a common needle bed before the connection.

6. A method as defined in claim 1; and further comprising producing of a connecting seam of the knitted parts which extends in a horizontal direction.

7. A method as defined in claim 1; and further comprising producing of a connecting seam of the knitted parts which extends in a vertical direction.

8. A method as defined in claim 1; and further comprising producing of a connecting seam of the knitted parts which extends inclinedly at an angle.

* * * * *